United States Patent [19]

Lin

[11] Patent Number: 4,709,565

[45] Date of Patent: Dec. 1, 1987

[54] UNITED OPENING DEVICE FOR A DOUBLE-LOCKED DOOR

[76] Inventor: Jui C. Lin, 297, Bor Ay Rd., Kaohsiung City, Taiwan, 800

[21] Appl. No.: 923,869

[22] Filed: Oct. 28, 1986

[51] Int. Cl.[4] ..... E05B 59/00

[52] U.S. Cl. ..... 70/107; 70/118; 70/481

[58] Field of Search ..... 70/107–111, 70/118–120, 481, 484–485, DIG.63; 292/34, 36, 37, 40, 47–49, 139–140, 143

[56] References Cited

U.S. PATENT DOCUMENTS

| | | | |
|---|---|---|---|
| 3,910,613 | 10/1975 | Nolin | 70/107 |
| 3,990,277 | 11/1976 | Mullich | 70/107 |
| 3,999,789 | 12/1976 | Maurits | 70/107 |
| 4,129,019 | 12/1978 | Urdal | 70/107 |
| 4,183,563 | 1/1980 | Stevens | 70/107 |
| 4,418,552 | 12/1983 | Nolin | 70/107 |

*Primary Examiner*—Robert L. Wolfe

*Attorney, Agent, or Firm*—Holman & Stern

[57] ABSTRACT

An opening device for simultaneously opening two locks of a double-locked door fixed only at the inside of the door for simplifying the action of opening from the inside comprises a cam-operated sliding plate displaceable by a cam actuator on the shaft of the main lock-rotating handle which when displaced simultaneously rotates the shaft of the auxiliary lock by camming action to the unlocked position, but when opening the door from the outside the device does not unlock both locks simultaneously and the opening process requires two separate operations for preserving the anti-burglary features of a normal double-lock system.

2 Claims, 21 Drawing Figures

UNITED OPENING DEVICE FOR A DOUBLE-LOCKED DOOR

BACKGROUND OF THE INVENTION

1. Field of the Invention

This invention relates to a device for opening both locks of a double-locked door simultaneously.

2. Description of the Prior Art

There is a need for anti-burglary devices and a door equipped with two or more locks is very popular for this purpose. Indeed, the more locks that are used, the safer houses are considered to be, but a plurality of locks makes it more inconvenient for dwellers to open a door because they have to unlock the locks one by one.

BRIEF SUMMARY OF THE INVENTION

It is an object of the invention to eliminate such inconvenience by providing a device which can unlock two locks simultaneously by only one action of turning the main lock.

This invention makes use of a linking plate which is bored with two straight slots which are respectively provided with a hooking hole at one of their ends so as to link with one end of a spring. The linking plate has a hook at its two sides sandwiched between a surface plate and a bottom plate. The surface and bottom plates are respectively bored with two shaft holes for matching with two shaft collars so as to respectively receive a main lock and an auxiliary lock; and the two shaft collars are each coupled with a main and an auxiliary disc. When the main lock is turned manually the main disc will force the linking plate to move and another hook of the linking plate will simultaneously cause the auxiliary disc to rotate which results in a united opening action for both the locks at the same time.

BRIEF DESCRIPTION OF THE DRAWINGS

The invention will now be described in detail with reference to the accompanying drawings, wherein.

DETAILED DESCRIPTION

Figure 1:
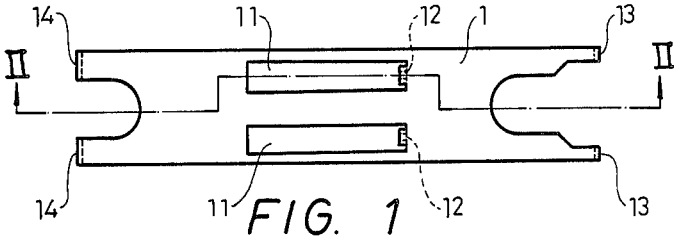
FIG. 1 is a top plan view of a linking plate of this invention.

This invention comprises linking plate 1, bottom plate 2, surface plate 3, main disc 4 and auxiliary disc 5 as important parts.

Figure 2:
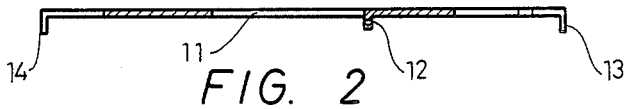
FIG. 2 is a cross-sectional view taken along line II—II of FIG. 1.

FIGS. 1 and 2 show the structure of linking plate 1, which is formed by pressing and has two straight slots 11, each of which is provided with hooking hole 12 at one of its ends for hooking with one end of a spring 6. Two ends of linking plate 1 are respectively provided with two hooks 13, 14.

Figure 3:
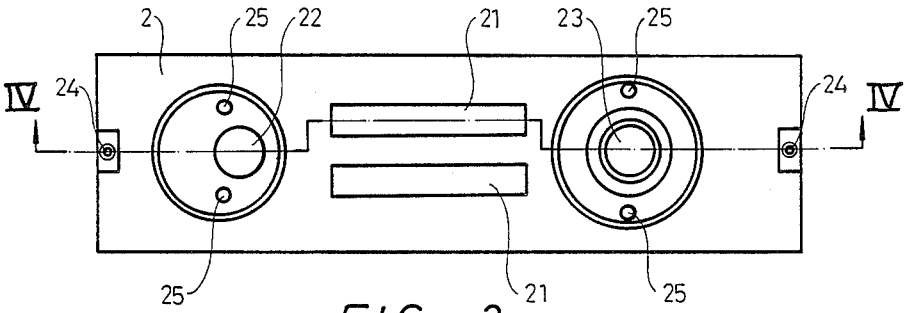
FIG. 3 is a to plan view of a bottom plate of this invention.
Figure 4:
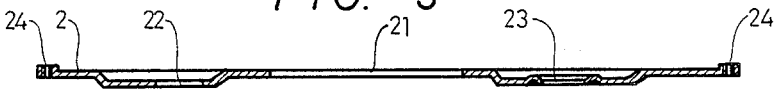
FIG. 4 is a cross-sectional view taken along line IV—IV of FIG. 3.

FIGS. 3 and 4 show the structure of bottom plate 2, which has two slots 21 aligned with slots 11 of linking plate 1 when assembled, two shaft holes 22, 23 for the shaft of a lock to run through, and two threaded holes 24 for screws 37 to attach the surface plate 3. In addition, at opposite sides of each shaft hole 22, 23 are bored two holes 25 for fixing the bottom plate on a door.

Figure 5:
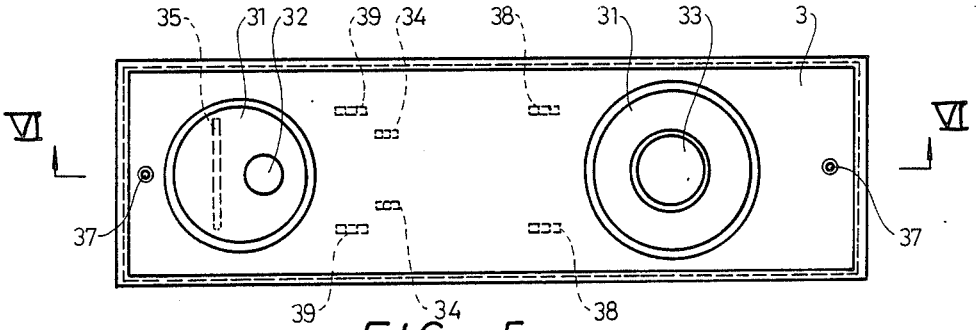
FIG. 5 is a top plan view of a surface plate of this invention.
Figure 6:
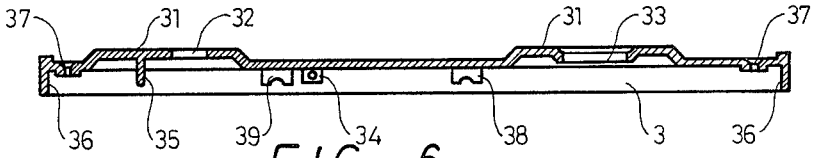
FIG. 6, is a cross-sectional view taken along line VI—VI of FIG. 5.
Figure 19:
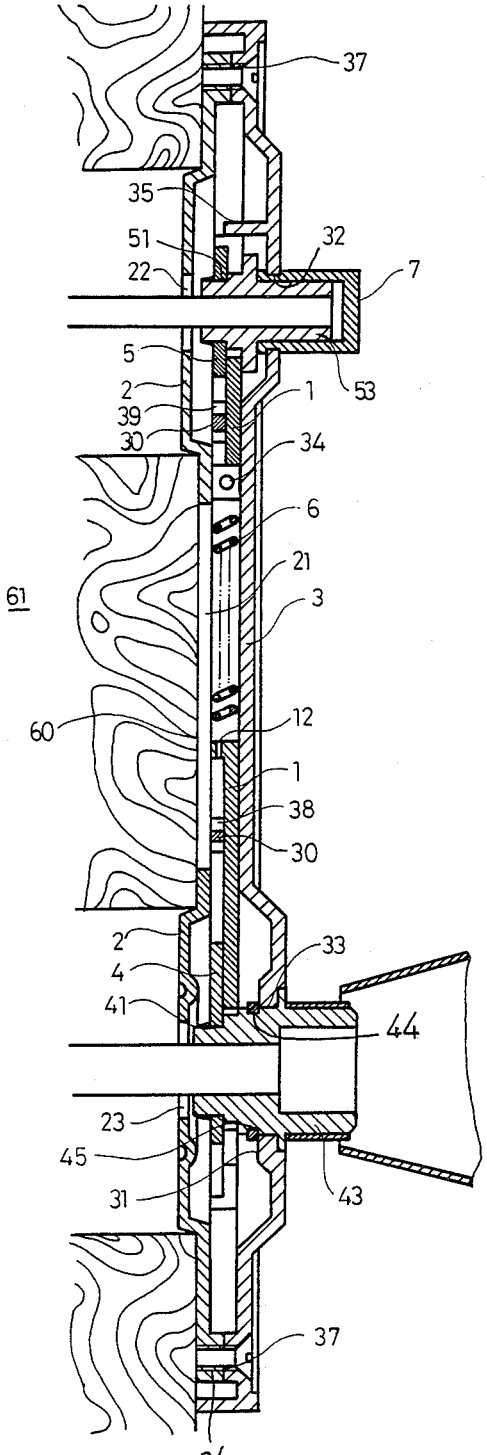
FIG. 19 is a vertical cross-sectional view through the lock assembly of FIG. 18.

FIGS. 5 and 6 show the structure of surface plate 3. The inside of surface plate 3 has two offset concave discs 31, which are to match, respectively, with main disc 4 and auxiliary disc 5, which are bored with round holes 32, 33 for the shafts of two locks to run through, two hooking holes 34 for spring 6 to hook to, and guarding wall 35 for restricting movement of linking plate 1. Peripheral wall 36 spaces surface plate 3 from the bottom plate to provide operating space between them for linking plate 1 after surface plate 3 is fixed on a door. Surface plate 3 is fixed on bottom plate 2 by screws 37 engaging holes 24 (FIG. 19). Two sets of U-shaped restricting projections 38, 39 are provided at the inside bottom of surface plate 3 to limit linking plate 1 to move in a straight line between them. Two retaining bars 30 engage with the two sets of U-shaped restricting projections 38, 39 by pressing the bars into the projections to retain linking plate 1 on surface plate 3.

Figure 7:
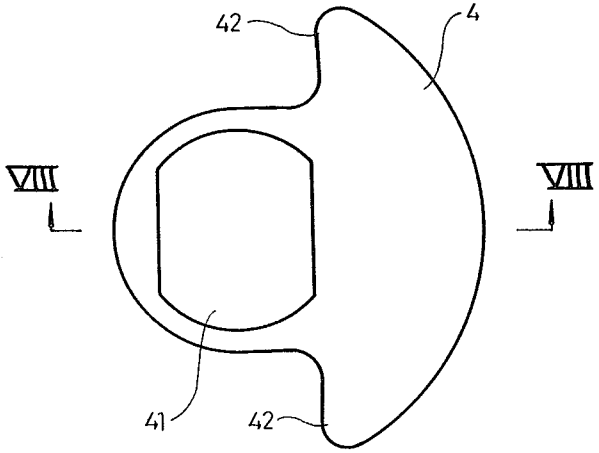
FIG. 7 is a top plan view of a main disc of this invention.
Figure 8:
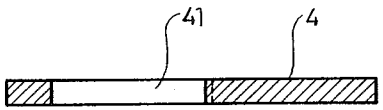
FIG. 8 is a cross-sectional view taken along line VIII—VIII of FIG. 7.

Main disc 4, as shown in FIGS. 7 and 8, has hole 41 therein for the shaft of the main lock, described below, and has two protruding rings 42 on its two sides.

Figure 9:
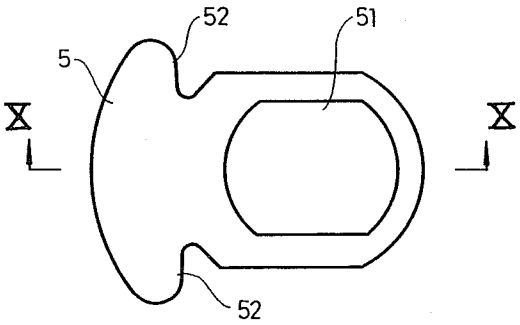
FIG. 9 is a top plan view of an auxiliary disc of this invention.
Figure 10:
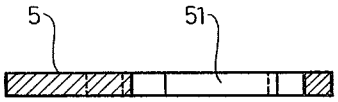
FIG. 10 is a cross-sectional view taken along line X—X of FIG. 9.

Auxiliary disc 5, as shown in detail in FIGS. 9 and 10, is provided with shaft hole 51 for the shaft of an auxiliary lock 7 to run through and with two linking protrusions 52 at its two sides.

Figure 11:
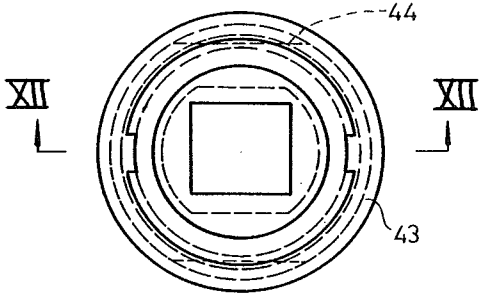
FIG. 11 is a top plan view of a main shaft collar of this invention.
Figure 12:
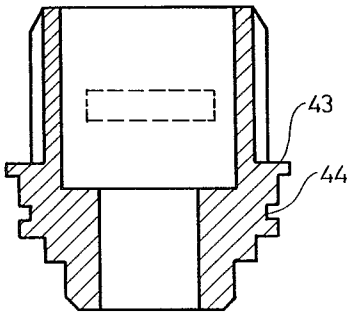
FIG. 12 is a cross-sectional view taken along line XII—XII of FIG. 11.

FIGS. 11 and 12 show the structure of main shaft collar 43 which is to combine with a lever handle lock, a tubular lock or an antique lock, and activates main disc 4 when rotated. In slot 44 in main shaft collar 43, C-shaped retaining ring 45 (FIG. 19) retains main shaft collar 43 in round hole 33 of surface plate 3.

Figure 13:
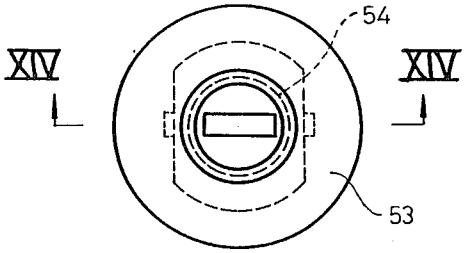
FIG. 13 is a top plan view of an auxiliary shaft collar of this invention.
Figure 14:
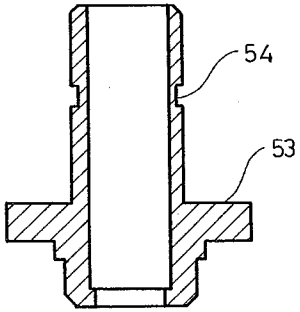
FIG. 14 is a cross-sectional view taken along line XIV—XIV of FIG. 13.

Next, as shown in FIGS. 13 and 14, auxiliary shaft collar 53 is used for coupling with an auxiliary lock and to activate auxiliary disc 5 when rotated. And ring slot 54 in shaft collar 53 can be used to retain shaft collar 53 in round hole 32 of surface plate 3.

Both shaft collars 43 and 53 make use of their internal shaft holes for combining with the shafts of various kinds of locks, so that when each lock is rotated, the respective shaft collar is rotated simultaneously. Additionally, the external elliptical shape of shaft collars 43, 53 lock into shaft holes 41, 51 of main disc 4 and auxiliary disc 5 so that when shaft collars 43, 53 are rotated, discs 4 and 5 are also activated to rotate at the same time.

Figure 18:
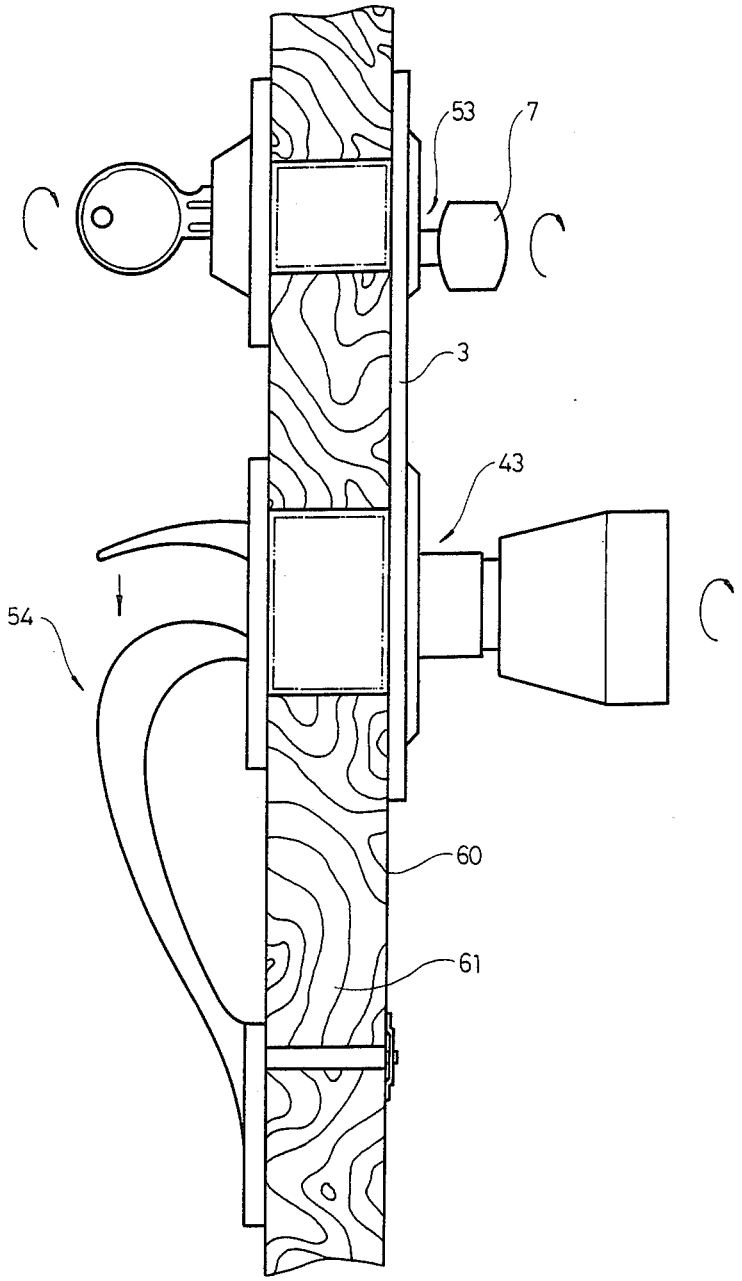
FIG. 18 is a side elevational view of a door utilizing the first example of this invention.
Figure 20:
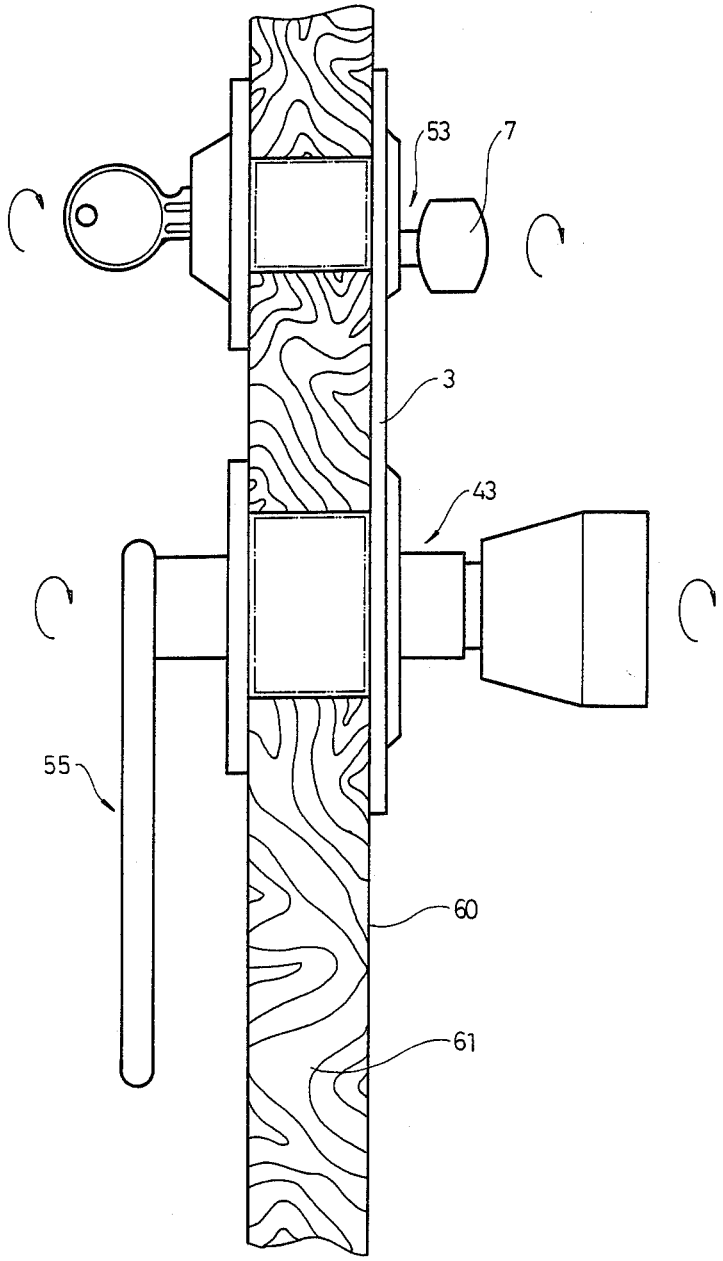
FIG. 20 is a view similar to FIG. 18 showing the second example of this invention with a lever handle lock.
Figure 21:
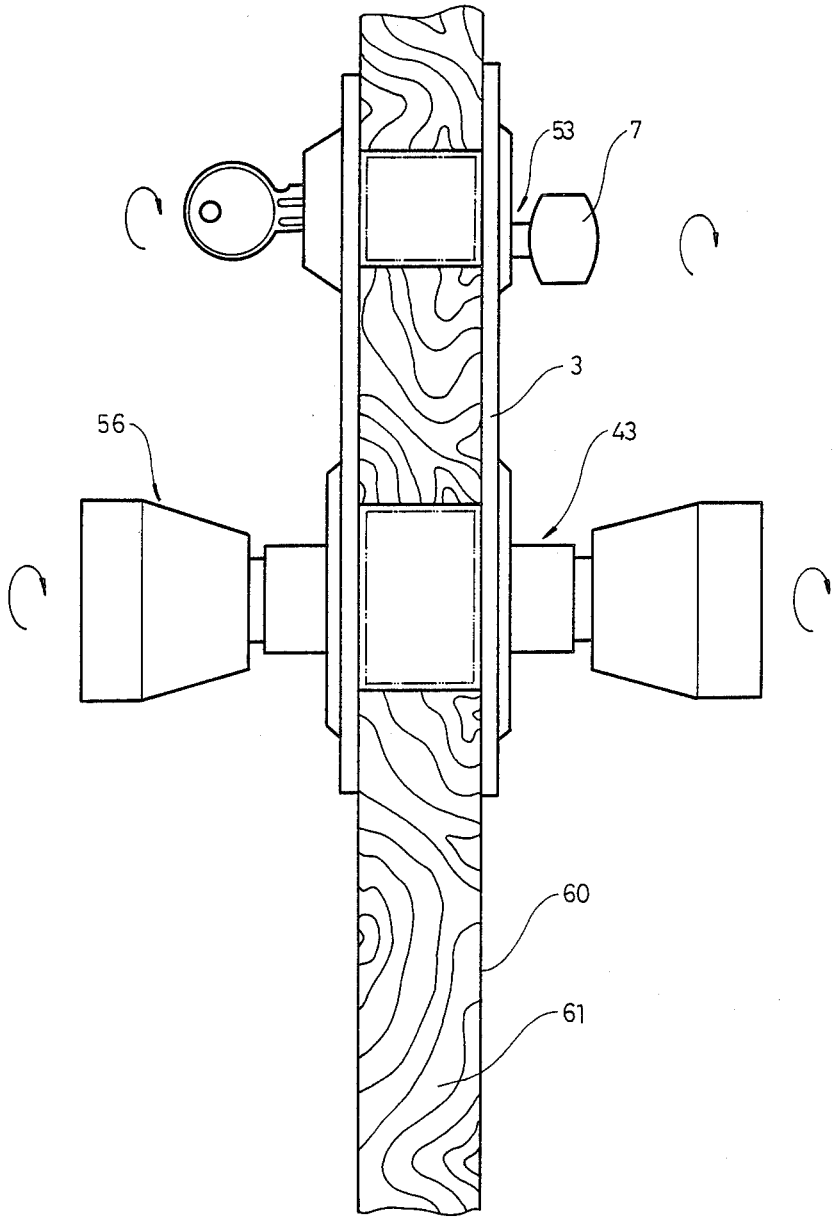
FIG. 21 is a view similar to FIG. 18 showing the third example of this invention with a tubular lock.

FIG. 19 shows a cross-sectional view of the first embodiment of this invention. Linking plate 1 is slidable on the inside surface of plate 3 and retained by bars 30. Main disc 4 is positioned behind linking plate 1 and shaft collar 43 is assembled in round hole 33 of surface plate 3. Shaft collar 43 is combinable with an antique lock 54 as shown in FIG. 18, with a lever handle lock 55 as shown in FIG. 20, or a tubular lock 56 as shown in FIG. 21. Auxiliary disc 5 is assembled on shaft collar 53 which is assembled in round hole 32 of surface plate 3. Shaft collar 53 is combinable with the turning button 7 of an auxiliary lock. The main and auxiliary lock assemblies are installed on the inside of surface plate 3 to become unitary activating devices fixed on the inner surface 60 of a door 61, as shown in FIG. 18.

One common property of an auxiliary lock, a main antique, lever handle, or tubular lock, etc., is that each of the locks must be independently turned around from the inner or the outer side of a door to force its dead bolt to move in or out. The simultaneous opening device of this invention is installed at the inner side of a door, so that opening a door from the outside still requires a normal process, i.e., two independent steps are necessary for opening a door from the outside to preserve the anti-burglary feature.

Figure 15:
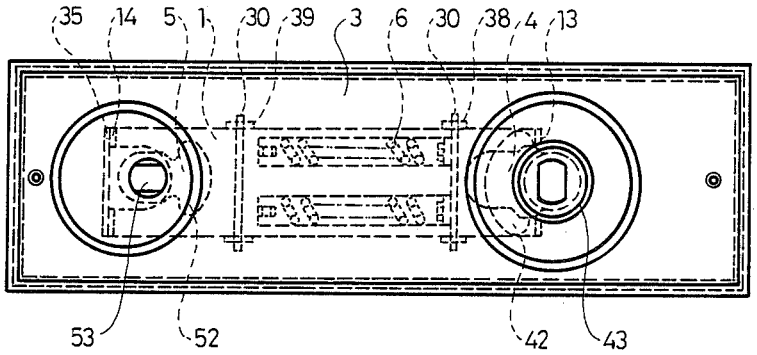
FIG. 15 is a top plan view of this invention assembled with two locks in unlocked position.

FIG. 15 shows a top view of this invention in the position where the auxiliary lock is not locked. Two linking protrusions 42 of main disc 4 keep in contact with one hook 13 of linking plate 1, hooking holes 12, 34 are respectively hooked by one end of springs 6, and the two linking protrusions 52 do not contact with either hook 14 of linking plate 1.

Figure 16:
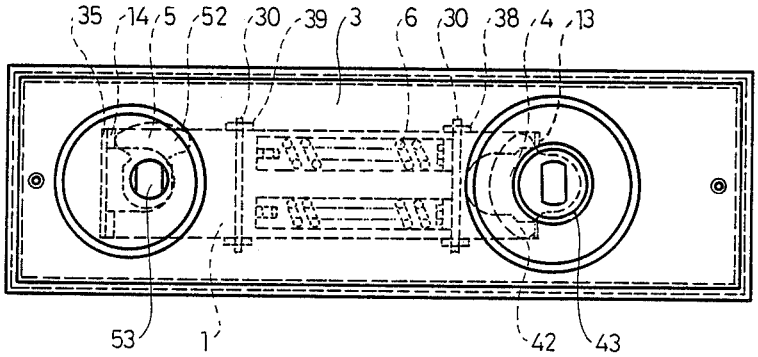
FIG. 16 is a top plan view of this invention assembled with two locks in locked position.

FIG. 16 shows all the locks locked from the inside. The locked condition of an antique lock, lever handle lock, or tubular lock, does not affect the position of main disc 4. But the locking method of an auxiliary lock is to rotate turning button 7. Whether turning button 7 is turned clockwise or counterclockwise, auxiliary disc 5 and shaft collar 53 are turned with it and one of the linking protrusions 52 comes in contact with and moves one hook 14 of linking plate 1.

Figure 17:
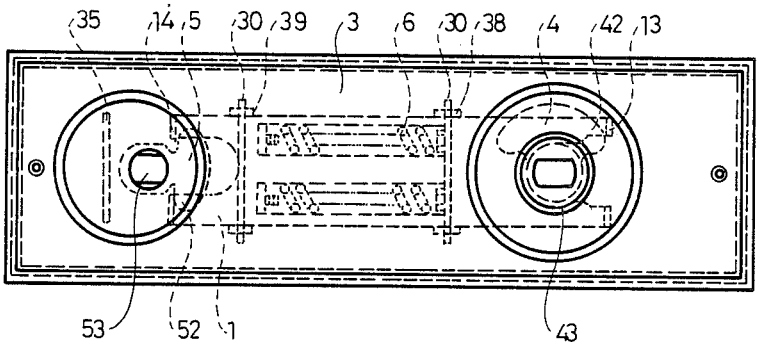
FIG. 17 is a top plan view of this invention assembled in operating condition.

Supposing that the unitary opening device of this invention is not equipped on a door, and that it is necessary to open the door from the inside as shown in FIGS. 18, 20, 21 when both locks are in the locked position, then it is necessary to turn turning button 7 to its unlocking state and then rotate the main lock to the unlocked position for the purpose of opening the door. But, if the door is equipped with this invention, as shown in FIG. 16, it is not necessary to rotate turning button 7 first, but only to turn the main lock directly so that linking protrusions 42 of main disc 4 move hook 13 thereby moving linking plate 1 (FIG. 17) whereby hook 14 at the other end of linking plate 1 pushes linking protrusions 52 of auxiliary disc 5 which rotates until the auxiliary lock is totally opened as shown in FIG. 17, thus allowing opening the door. That is, the rotation of turning button 7 and the main lock pull their dead bolts inside out of the door frame. When the force for rotating the main lock ceases, the main lock will recover its normal state as in the known art of a conventional door lock, and linking plate 1 will also recover its normal position through the action of return springs 6 to the retracted position where it is stopped by guarding wall 35.

In conclusion, this invention provides a convenient device that saves time in opening a door with two locks from inside without sacrificing any anti-burglary effect.

I claim:

1. In an opening device for simultaneously opening two locks on a double-locked door including a main lock operated by a rotatable main shaft, an auxiliary lock operated by a rotatable shaft spaced from the main lock shaft, a main cam member operatively engaged with the main lock shaft to be rotated thereby, a sliding linking plate having main cam followers thereon engageable with the main cam member so that rotation of the main cam member reciprocally displaces the linking plate, auxiliary camming members on the linking plate, an auxiliary lock operated by a rotatable auxiliary shaft, and an auxiliary cam follower on the auxiliary shaft for rotation therewith and operatively engageable with the auxiliary camming members, so that when the auxiliary lock is in the locked position the auxiliary cam followers engage one of the auxiliary camming members and displacement of the linking plate by unlocking rotation of the main shaft simultaneously unlocks the auxiliary lock by displacement of one of the auxiliary camming members which rotates the auxiliary cam follower, the improvement comprising:

two substantially straight slots in the linking plate;

a hooking hole at one end of each slot;

the main cam followers and auxiliary camming members being hook members projecting from opposite ends of the linking plate;

a bottom plate having two slots therein aligned with said slots in the linking plate;

two shaft holes in said bottom plate for receiving the main and auxiliary shafts, respectively;

a plurality of screw holes in said bottom plate for use in attaching said bottom plate to a door;

a surface plate attachable to said bottom plate;

means for attaching said surface plate to said bottom plate;

two offset concave disc sections on said surface plate having two shaft holes therethrough aligned with said two shaft holes in said bottom plate for receiving the main and auxiliary shafts, respectively;

two hooking holes on the interior surface of said surface plate facing said bottom plate;

tension springs in said slots connected at opposite ends thereof to said linking member hooking holes and said surface plate hooking holes, respectively;

a spacing edge wall around the periphery of said surface plate for spacing said surface plate from said bottom plate;

guide members projecting from the interior surface of said surface plate for guiding the linking plate to move in a substantially straight line;

retaining bars attachable to said guide members in spaced relationship and slidingly engaging the surface of the linking plate facing said bottom plate for retaining the linking plate for sliding movement on said surface plate;

the auxiliary cam follower being an auxiliary disc member having oppositely extending cam follower elements therein engageable adjacent the outer ends thereof with the auxiliary camming members when said auxiliary shaft is in the locking position and disengaged from the auxiliary camming members when in the unlocked position; and a stop member projecting inwardly from said offset concave disc section adjacent the position of the auxiliary shaft for limiting sliding movement of the linking plate in the non-operating retracted position under the resilient force of said tension springs.

2. The improvement as claimed in claim 1 and further comprising:

cut-out openings at both ends of the linking plate extending from the ends of the linking plate between the main cam followers and auxiliary camming members, respectively, inwardly toward said slots in the linking plate a distance sufficient to allow sliding movement of the linking plate to unlock the auxiliary lock upon unlocking action of the main lock;

said hook members which comprise the main cam followers and auxiliary camming members project from respective ends of the linking member toward said bottom plate; and said main cam member and auxiliary cam follower are disposed between the linking plate and said bottom plate.

* * * * *